United States Patent [19]

Yonezawa et al.

[11] 4,317,358

[45] Mar. 2, 1982

[54] DIE LIFTER UNIT FOR PRESSING OR PUNCHING MACHINE

[76] Inventors: Keitaro Yonezawa; Ichiro Kitaura, both of c/o Aioiseiki K.K. 14, Aza Hattanda, Hama, Amagasakishi, Hyogoken, Japan

[21] Appl. No.: 150,144

[22] Filed: May 15, 1980

[30] Foreign Application Priority Data

Jun. 5, 1979 [JP] Japan ..... 54-76671[U]

[51] Int. Cl.[3] ..... B21J 13/02; B30B 15/02

[52] U.S. Cl. ..... 72/448; 100/229 R; 100/918

[58] Field of Search ..... 72/446, 447, 448; 100/224, 229 R, 918

[56] References Cited

U.S. PATENT DOCUMENTS

| | | | |
|---|---|---|---|
| 3,111,100 | 11/1963 | Georgeff | 100/918 |
| 3,139,679 | 7/1964 | Grover | 100/918 |
| 4,152,978 | 5/1979 | Abe | 100/918 |
| 4,258,620 | 3/1981 | Sallander | 72/446 |

FOREIGN PATENT DOCUMENTS

| | | | |
|---|---|---|---|
| 1496270 | 9/1967 | France | 72/448 |

*Primary Examiner*—Gene P. Crosby
*Attorney, Agent, or Firm*—Bacon & Thomas

[57] ABSTRACT

A die lifter unit comprises a rolled metal section of inverted open-topped rectangular shape which is floatably supported on heavy duty springs in a groove extending along the top surface of the bolster, the section carrying a roller for supporting the die.

10 Claims, 12 Drawing Figures

DIE LIFTER UNIT FOR PRESSING OR PUNCHING MACHINE

BACKGROUND OF THE INVENTION

1. Field of the Invention

The present invention relates to a spring-loaded die lifter unit for use in a pressing or punching machine. More particularly, the present invention relates to a spring-loaded die lifter unit floatably provided in the bolster of the machine, wherein the die lifter unit includes a bar-shaped carrier of rollers which carrier is supported by heavy duty springs in grooves extending along the bolster, thereby allowing the die to roll and move smoothly on the rollers.

2. Description of the Prior Art

In a pressing or punching machine for moulding or punching die must be frequently dismounted from the bolster for replacement or repair, but because of its heavy weight it is required to employ a special tool, such as a crane. In order to overcome this difficulty a hydraulic die lifter has been proposed, wherein the die-supporting rollers are hydraulically raised to lift the die above the top surface of the bolster so as to allow the same to smoothly roll thereon.

However, the provision of a hydraulic system in the bolster requires a complicated and troublesome preparatory work, which of course results in an increased production cost. Another disadvantage is that the hydraulic system must be operated each time when the die is mounted or dismounted, which is time- and labor-consuming.

In order to solve such problems of high cost and troublesome operation, a spring-loaded die lifter has been proposed which die lifter includes balls supported on heavy duty springs in their respective holes in the bolster. The balls normally protrude above the top surface of the bolster. When the die is fastened to the bolster by means of hydraulic clamps, the balls are caused to sink below the top surface of the bolster under the oppression by the clamps against the springs.

However, this arrangement requires a lot of boring work which is labor-consuming and costly. In addition, the die is liable to engraved marks caused by the ball surfaces, which tends to bring about undesired play between the die and the bolster. Furthermore, it is disadvantageous in that the balls are likely to drift in their holes, and consequently, it becomes necessary to provide any device so as to hold the balls at rest, which leads to the construction of a complicated and large-sized mechanism. This also increases the production cost.

The present invention is directed toward solving the problems and disadvantages mentioned above, and has for its object to provide an improved die lifter unit operating without the use of any hydraulic power, thereby resulting in a simplified die lifter unit. Another object of the present invention is to provide an improved die lifter without the possibility of damaging the die.

Other objects and advantages of the present invention will become obvious to one skilled in the art from the following description and drawings.

SUMMARY OF THE INVENTION

According to the present invention, a die lifter unit comprises a rolled metal section of inverted open-topped rectangular shape which is floatably supported on heavy duty springs in a groove extending along the top surface of the bolster, the section carrying a roller for supporting the die.

According to another aspect of the present invention, a die lifter unit comprising a roller carrier unit fitted in the entrance corner of the bolster, the carrier unit carrying a single heavy duty roller for supporting the die at the entrance of the bolster.

DETAILED DESCRIPTION OF THE INVENTION

Figure 1:
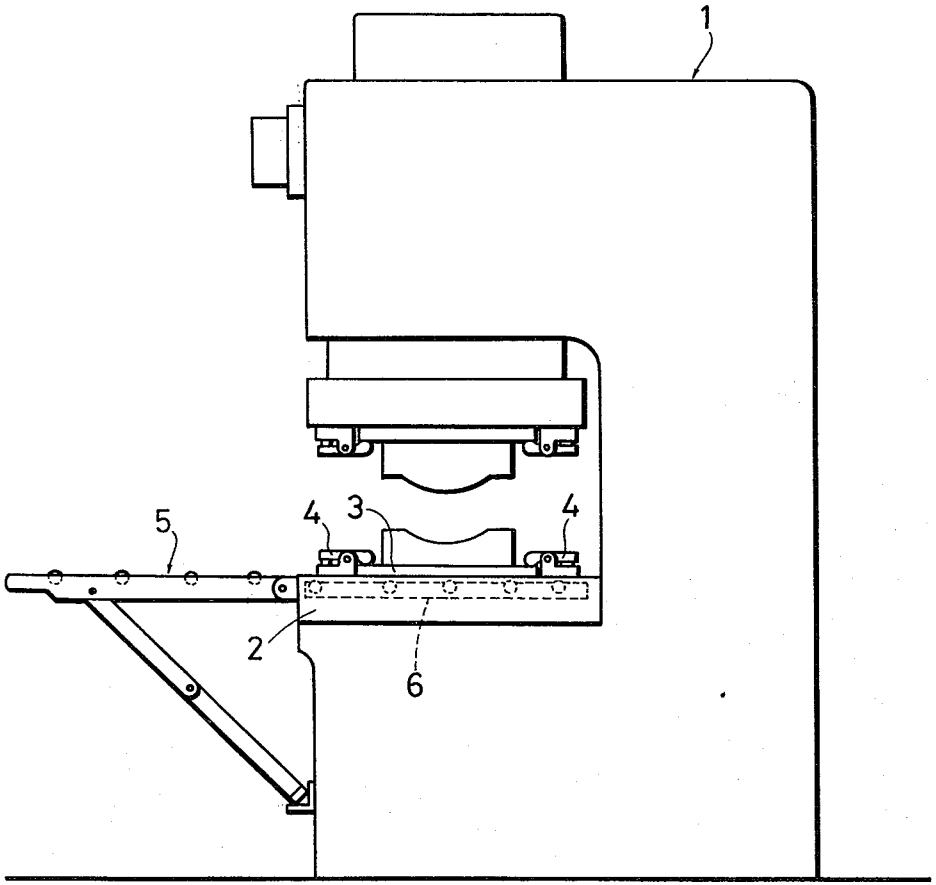
FIG. 1 is an overall side view of a pressing machine including a die lifter unit and a die carrier unit.
Figure 2:
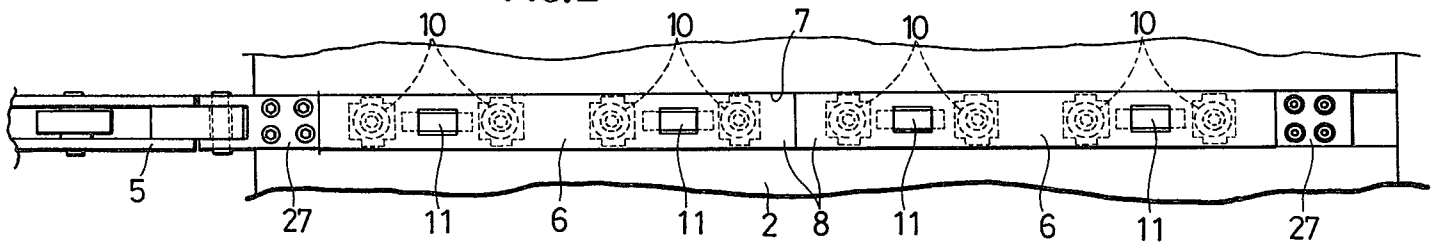
FIG. 2 is a plan view of the die lifter unit according to the present invention.

FIG. 1 shows a pressing machine, generally designate by reference numeral 1, including a bolster 2, a die 3 and a pair of hydraulic clamps 4. The die 3 is transported on an auxiliary carrier unit 5 for mount and dismount, wherein the auxiliary carrier unit is foldable. On the bolster, however, the die is transported on die lifter units 6 while rolling thereon, as described below.

The die lifter unit 6 includes a roller metal section 8 of inverted open-topped rectangular shape, which is floatably fitted in an inverted T-shaped groove 7 produced along the length of the bolster 2. The section 8 carries one or more rollers 11 by shafts 12. Each roller is supported such that part of its peripheral surface protrudes through a slot 13 produced on the central web of the second 8.

In addition, the section 8 includes side openings 16 in its side walls in which a cross-shaped plate 15 is placed. The plate 15 includes an internally-threaded boss 19 in its center, and a pair of extended edge portions 17 received in the side openings 16. Through the boss 19 a bolt 20 is screwed in.

Figure 6:
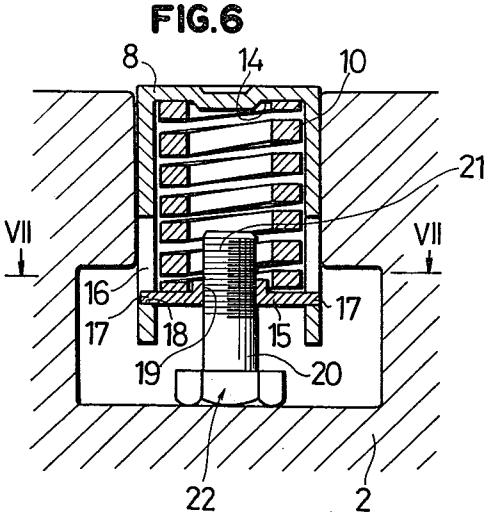
Figure 7:
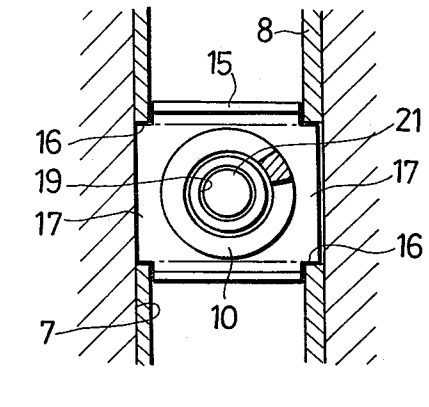
FIG. 7 is a plan view of the part in FIG. 6, taken along the line VII—VII therein.

The back of the central web of the section 8 provides a first spring-seat 14 while the plate 15 provides a second spring-seat between which seats a heavy duty spring 10 is received. In this way the section 8 is supported by the bolts 20 upright on the bolster 2 with the springs 10 being interposed therebetween as best shown in FIG. 6. The height of the section 8 can be adjusted by rotating the bolt 20, wherein the plate 15 is allowed to move in the side openings 16. Preferably the bolt 20 is provided with a head 22 so as to allow the bolt to stand stably on the bolster.

Figure 8:
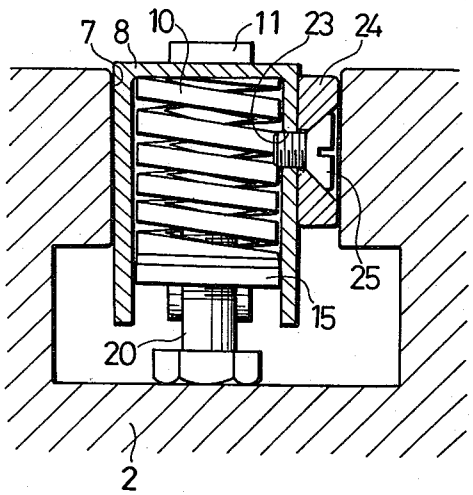
FIG. 8 is a vertical cross-section of a modified version of the part in FIG. 6.

It is required that no play is permitted between the section 8 and the cut face of the bolster 2, but if a relatively large space exists therein, a spacer 24 can be inserted as shown in FIG. 8. In this embodiment the spacer 24 is fastened to the section 8 by means of a flat-headed screw 25. This arrangement is advantageous in that so long as the section 8 is narrower in width than the T-shaped groove, metal sections of any width can be used.

Figure 4:
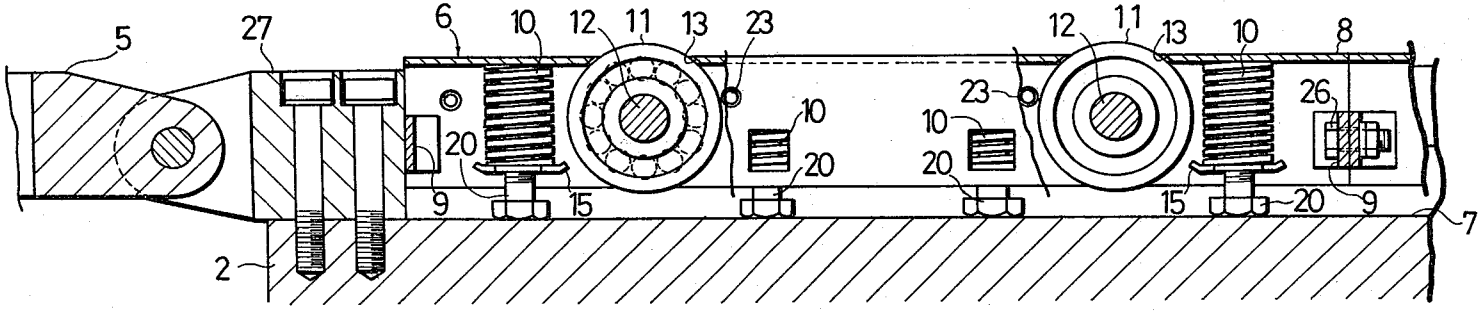
FIG. 4 is a vertical cross-section on a larger scale partly broken away, of the die lifter unit in FIG. 3.
Figure 5:
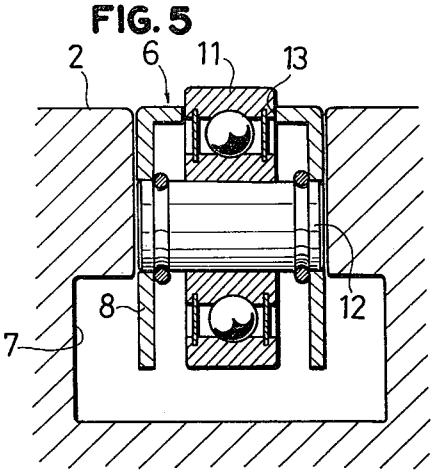
FIGS. 5 and 6 are vertical cross-sectional views on an even larger scale of the main part of the die lifter unit in FIG. 4.

The inverted T-shaped groove 7 is produced from one end to the other of the bolster 2, and after the section 8 is placed therein, the groove 7 is closed by metal pieces 27 which are fastened to the bolster at each end thereof so as to prevent the section 8 from moving longitudinally in the groove 7. The section 8 is provided with transverse plates 9 at each end, which plates are used to joint adjacent sections by bolts 26 in the groove 7 as shown in FIG. 4. In a preferred embodiment the entire length of the die lifter 6 is 200 mm with two rollers 11 having a 100 mm pitch. As another preferred embodiment there can be prepared a die lifter of 300 mm long, which is connected to the die lifter of 200 mm long so as to elongate the total length of the die lifter by 100 mm.

Figure 3:
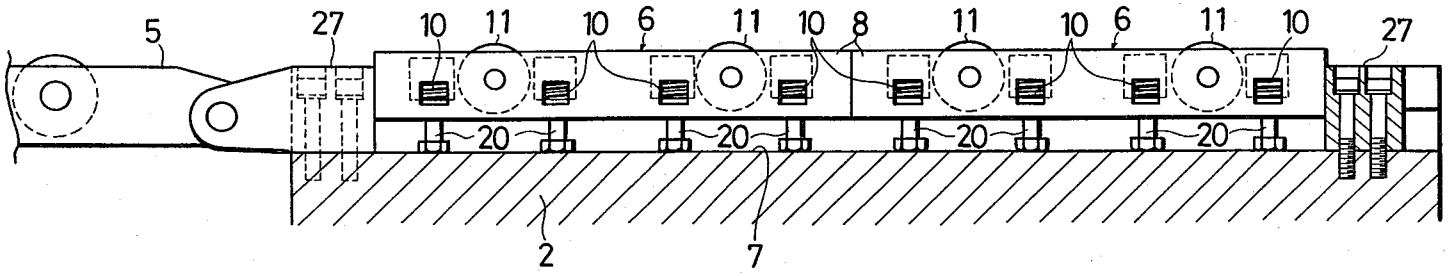
FIG. 3 is a vertical cross-section through the die lifter unit in FIG. 2.

A typical example of the operation of the die lifter will be explained:

The die lifter 6 normally rises above the top surface of the bolster by support of the heavy duty springs 10 as shown in FIG. 3, where the rollers 11 protrude their peripheral surfaces in a such manner as to receive the die 3. The die 3 can roll on the rollers whereby it is readily transported either for mount or dismount. When the die 3 is fastened to the bolster 2 by means of the pair of hydraulic clamps 4, the die lifter 6 undergoes oppression provided by the clamps and is caused to sink against the heavy duty springs 10. When the die 3 is released of the clamps 4, the die lifter 6 rises up under the action of the springs 10, thereby lifting the die above the top surface of the bolster, and placing the same into a slidable state on the rollers 11.

Figure 10:
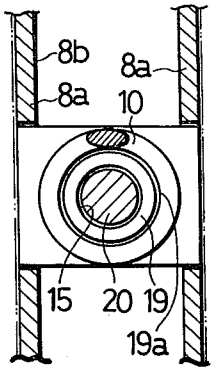
FIGS. 9 and 10 are vertical cross-sections of a further modified version corresponding to the embodiment in FIGS. 6 and 7.
Figure 12:
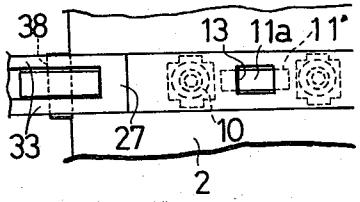
FIG. 12 is a plan view of the roller carrier unit in FIG. 11.
Figure 9:
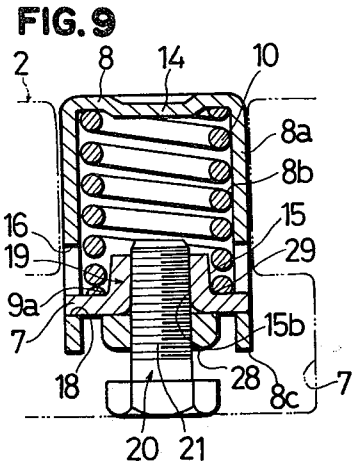

Various modifications of the embodiment can be made without departing from the spirit of the present invention. For example, the following modifications are possible:

As shown in FIGS. 9 and 10, the plate 15 can be of purely rectangular shape, in which the edge portions 17 are likewise received in the side openings 16 of the section 8. This arrangement is advantageous in that the plate can be readily inserted into the side openings 16. However, in this embodiment the plate 15 is likely to slip off the side openings 16, and to prevent it, the spring 10 has a sufficient diameter to extend adjacent to the inner surfaces **8*b* of each wall 8*a* of the section 8. At the same time, a thicker boss 29 is provided so as to tightly fit in the spring 10, thereby preventing the plate 15 from slipping off the side openings. When the plate 15 is to be inserted into the side openings, the spring 10 is upwardly compressed by a suitable tool, so as to allow the plate to be placed therein. Then, the spring is returned into its normal state, and its end portion rests on the plate 15**.

Figure 11:
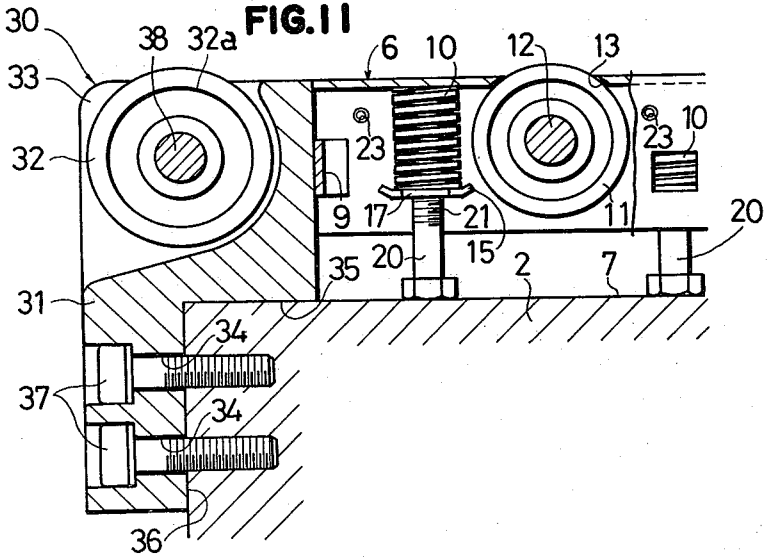
FIG. 11 is a vertical cross-section of a roller carrier unit used for the die lifter unit.

Instead of the conventional foldable carrier unit shown in FIG. 1, a roller carrier unit 30 can be provided at the entrance corner of the bolster as shown in FIG. 11. The roller carrier unit 30 carries a single heavy duty roller 32 so as to support the die and smoothly transfer the same onto the die lifter unit 6. The roller 32 is carried on a spindle 38 transversely supported on a two-pronged upper part 33 of a support metal 31 which additionally includes a downwardly extending lug portion 36 in which two anchoring holes 34 are passed through. The support metal 31 is fastened to the front of the bolster 2 by means of bolts 37 screwed in the holes 34. Reference numeral 35 designates a shoulder portion between the two-pronged upper part 33 and the downwardly extending lug portion 36, which shoulder portion is adapted to rest on the bolster 2. The heavy duty roller 32 is carried on the spindle 38 such that its peripheral part **32*a* rise up above the top surface of the support metal 30**.

This alternative embodiment is advantageous in that the necessity of preparing the carrier unit in its usable state has been eliminated, and that it is not necessary to provide the pressing machine with a special space which was necessary under the arrangement of a conventional foldable carrier unit.

What is claimed is:

1. A die lifter unit for use in a pressing or punching machine having a bolster, said unit comprising:

an inverted substantially U-shaped rolled metal section having a central web;

said section having at least one slot in said central web in which a roller is rotatably carried with its peripheral surface partly protruding above the surface of said central web;

said section being disposed in a groove extending along the top surface of the bolster of said machine, wherein said section is supported in suspension by a heavy duty spring;

said spring resting on a spring seat transversely supported on opposite side walls of said section;

said spring seat having an internally threaded central boss through which a standard is threadably passed for supporting said section wherein said standard is upright on the bottom of said groove; and said section being vertically movable with respect to said spring seat which is secured to said standard.

2. A die lifter unit as claimed in claim 1, wherein said section has openings in its opposite side walls for receiving said spring seat therein, thereby enabling said section to vertically move with respect to said spring seat when load is downwardly applied thereto.

3. A die lifter unit as claimed in claim 2, wherein said spring seat includes transverse edge portions that extend into said openings.

4. A die lifter unit as claimed in claim 1, wherein said standard includes a headed bolt.

5. A die lifter unit as claimed in claim 1, wherein said section is provided with plates transversely secured at opposite ends whereby two sections may be abutted together and joined lengthwise.

6. A die lifter unit as claimed in claim 1, further comprising a spacer whereby said section is fittingly located in said groove wherein said spacer is detachably provided on an outside surface of a side wall of said section.

7. A die lifter unit as claimed in claim 2, wherein said spring seat is of a substantially rectangular shape whose extended edge portions are received in said openings and wherein said central boss is of a thickness to fit in said spring.

8. A die lifter unit as claimed in claim 1, further comprising a carrier unit for transporting a die, wherein said carrier unit comprises a single roller rotatably carried at the entrance corner of the bolster with its peripheral surface being partly exposed above the top surface of said bolster.

9. A die lifter unit as claimed in claim 8, wherein said carrier roller is carried on a support metal member which is detachably attached to the front face of said bolster.

10. A die lifter unit as claimed in claim 9, wherein said support metal member includes a two-pronged upper part in which said carrier roller is rotatably carried on a spindle transversely supported between said prongs.

* * * * *